US005522119A

United States Patent [19]

Leifeld et al.

[11] Patent Number: 5,522,119

[45] Date of Patent: Jun. 4, 1996

[54] FIBER WEB SUPPORTING DEVICE IN A CARDING MACHINE

[75] Inventors: Ferdinand Leifeld, Kempen; Gerd Pferdmenges, Jüchen, both of Germany

[73] Assignee: Trützschler GmbH & Co. KG, Mönchengladbach, Germany

[21] Appl. No.: 293,802

[22] Filed: Aug. 22, 1994

[30] Foreign Application Priority Data

Aug. 24, 1993 [DE] Germany ..... 43 28 431.0

[51] Int. Cl.[6] ..... D01G 15/46

[52] U.S. Cl. ..... 19/106 R; 19/98

[58] Field of Search ..... 19/98, 108, 106 R

[56] References Cited

U.S. PATENT DOCUMENTS

| | | | |
|---|---|---|---|
| 2,788,547 | 4/1957 | Kaufman et al. | 19/98 X |
| 2,987,779 | 6/1961 | Kawashima | 19/106 R |
| 3,113,348 | 12/1963 | Varga | 19/106 |
| 3,355,774 | 12/1967 | Miyagi | 19/106 R |
| 4,257,148 | 3/1981 | Vaughn et al. | 19/98 |
| 4,279,060 | 7/1981 | Wirth | 19/106 R |
| 4,852,217 | 8/1989 | Bernhardt et al. | 19/98 |
| 4,884,320 | 12/1989 | Gasser et al. | 19/106 R |

FOREIGN PATENT DOCUMENTS

| | | | |
|---|---|---|---|
| 2312231 | 9/1974 | Germany | 19/106 R |
| 2846137 | 3/1980 | Germany . | |
| 38-4713 | 4/1963 | Japan | 19/106 R |
| 913080 | 12/1962 | United Kingdom . | |
| 1022087 | 3/1966 | United Kingdom . | |
| 1140762 | 1/1969 | United Kingdom | 19/106 R |
| 1223487 | 2/1971 | United Kingdom . | |
| 1231039 | 5/1971 | United Kingdom . | |
| 2192409 | 1/1988 | United Kingdom . | |

*Primary Examiner*—John J. Calvert
*Attorney, Agent, or Firm*—Spencer & Frank

[57] ABSTRACT

A carding machine includes a main carding cylinder; a doffer cooperating with the main carding cylinder for removing fiber material therefrom; a stripping roll cooperating with the doffer for removing a fiber web therefrom; upper and lower cooperating crushing rolls together defining a nip for grasping the fiber web running from the doffer and the stripping roll; and a fiber web supporting and guiding body stationarily positioned underneath the stripping roll. The body has a length dimension extending generally parallel to the rotary axis of the stripping roll and an upper surface for supporting and guiding thereon the fiber web. The upper surface has a width extending generally horizontally and transversely to the stripping roll axis and oppositely located first and second longitudinally extending edge zones. The first edge zone is situated in a region between the doffer and the stripping roll and the second edge zone is situated in a region between the stripping roll and the crushing rolls and is oriented towards the nip defined by the crushing rolls.

19 Claims, 3 Drawing Sheets

FIBER WEB SUPPORTING DEVICE IN A CARDING MACHINE

CROSS REFERENCE TO RELATED APPLICATION

This application claims the priority of German Application No. P 43 28 431.0 filed Aug. 24, 1993, which is incorporated herein by reference.

BACKGROUND OF THE INVENTION

This invention relates to a device disposed between a doffer and a crushing roll pair of a carding machine which treats cotton fiber, chemical fiber or the like. The device has an element which is stationarily disposed underneath a stripper roll which removes fiber material as a fiber web from a doffer. The upper surface of the element is oriented towards a region of the stripper roll and a terminal region of the element is situated in the zone between the doffer and the stripper roll.

In a known device the stationary element extends from the doffer to the middle of the stripper roll. The zone between the middle of the stripper roll and the downstream-arranged, superposed crushing rolls is downwardly open. The thin web which is separated at that region by the stripping roll from the doffer runs through a free space until it reaches the nip defined between the two crushing rolls. Upon an increase of the output speed of the card, that is, an increase, for example, to 300 m/min or above, the air stream flowing rearwardly from the crushing rolls interferes with the web travel. The air stream, particularly that which flows rearwardly from the nip between the crushing rolls eventually reaches such a high rearward speed that the unsupported, freely running fiber web is blown back in certain regions. Since the upper crushing roll is close to the stripping roll, the air entrained by the stripping roll may bound back from the upper crushing roll and may also have an adverse effect on the fiber web. The rearwardly directed air streams may press downwardly the thin fiber web, resulting in sagging and tear. Thus, at high delivery speeds the uniform material advance is adversely affected.

SUMMARY OF THE INVENTION

It is an object of the invention to provide a device of the above-outlined type which eliminates the discussed disadvantages and which, in particular, ensures a disturbance-free transition of the fiber web from the stripping roll to the crushing rolls at high delivery speeds.

This object and others to become apparent as the specification progresses, are accomplished by the invention, according to which, briefly stated, the carding machine includes a main carding cylinder; a doffer cooperating with the main carding cylinder for removing fiber material therefrom; a stripping roll cooperating with the doffer for removing a fiber web therefrom; upper and lower cooperating crushing rolls together defining a nip for grasping the fiber web running from the doffer and the stripping roll; and a fiber web supporting and guiding body stationarily positioned underneath the stripping roll. The body has a length dimension extending generally parallel to the rotary axis of the stripping roll and an upper surface for supporting and guiding thereon the fiber web. The upper surface has a width extending generally horizontally and transversely to the stripping roll axis and oppositely located first and second longitudinally extending edge zones. The first edge zone is situated in a region between the doffer and the stripping roll and the second edge zone is situated in a region between the stripping roll and the crushing rolls and is oriented towards the nip defined by the crushing rolls.

Thus, the top face of the supporting and guiding body constitutes a backup surface which supports the delicate, freely running fiber web from below. This surface prevents the web from being displaced downwardly and from sagging under the effect of harmful, rearward flowing air streams. Thus, fiber web portions which may be blown rearwardly are caught by the upper surface of the supporting and guiding body and are entrained by the web in the direction of the nip of the crushing roll pair. At the same time, the upper surface of the body positively guides the fiber web in the direction of the nip through the space between the stripping roll and the crushing roll pair.

DESCRIPTION OF THE PREFERRED EMBODIMENTS

Figure 1:
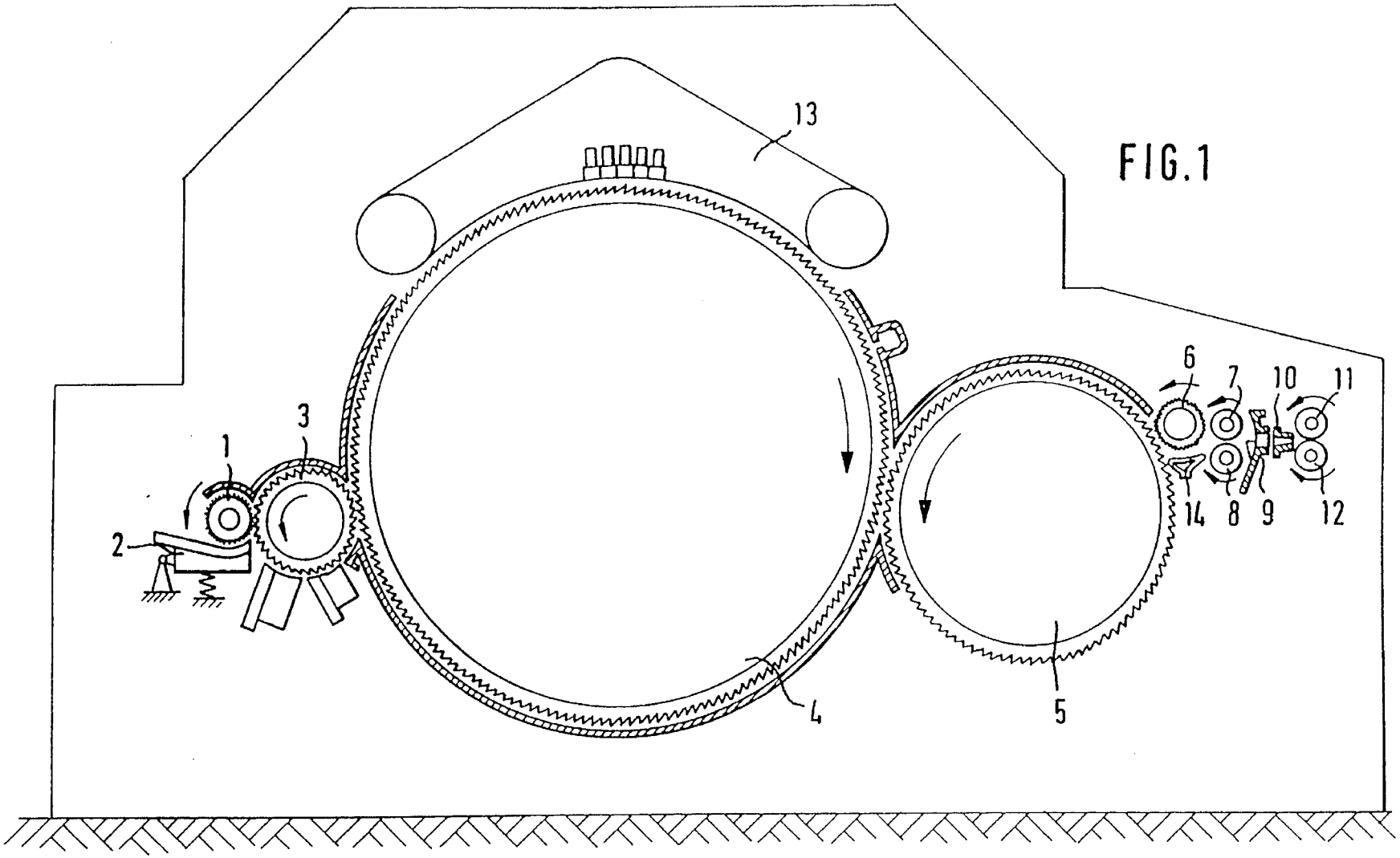
FIG. 1 is a schematic side elevational view of a carding machine incorporating the device according to the invention.

Turning to FIG. 1, there is shown therein a carding machine which may be, for example, an EXACTACARD DK 760 model manufactured by Trützschler GmbH & Co. KG, Mönchengladbach, Germany. The carding machine has a feed roller 1 cooperating with a feed table 2, a licker-in 3, a main carding cylinder 4, a doffer 5, a stripping roll 6, crushing rolls 7, 8, a web guide element 9, a trumpet 10, calender rolls 11 and 12 and travelling flats 13. A supporting and guiding body 14 according to the invention is arranged underneath the stripping roll 6. The upper crushing roll 7 immediately adjoins the stripping roll 6. The direction of rotation of the several rolls and rollers are indicated by arcuate arrows.

Figure 2:
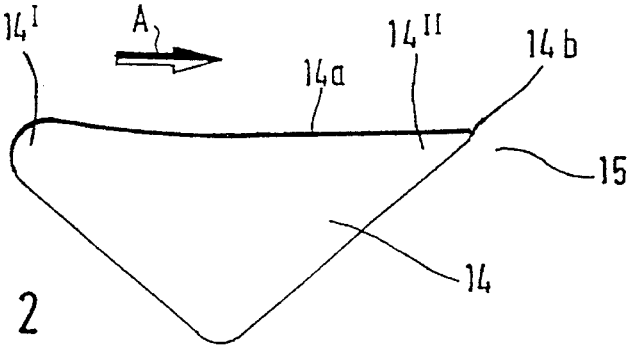
FIG. 2 is a side elevational view of a preferred embodiment of the invention.

As shown in FIG. 2, the supporting and guiding body 14 has a width measured in the direction A which corresponds to the web travelling direction and a length measured parallel to, for example, the rotary axis of the stripping roll 6. Thus, the length dimension of the body 14 extends parallel to the width dimension of the carding machine and consequently extends perpendicularly to the plane of FIGS. 1, 2 and 3. The cross section of the body 14, taken in a plane perpendicular to the body length, has a generally triangular shape. The principal working part of the body 14 is its upper surface **14*a* which is slightly concave in the direction A. The radius of curvature of the surface 14*a* is greater than the radius of the stripping roll 6. The frontal edge zone $\mathbf{14}^{II}$ of the body 14 has a relatively sharp edge 14*b* whereas the rearward edge zone $\mathbf{14}^{I}$ is rounded. The edge 14*b* prevents deposition of impurities, for example, honeydew. The surface 14*a* is cleaned, for example, of trash, by the overlying, running web. The cross-sectional configuration of the body 14 is adapted to the air flow conditions in the zone between the doffer 5, the stripping roll 6 and the crushing rolls 7, 8**.

Figure 3:
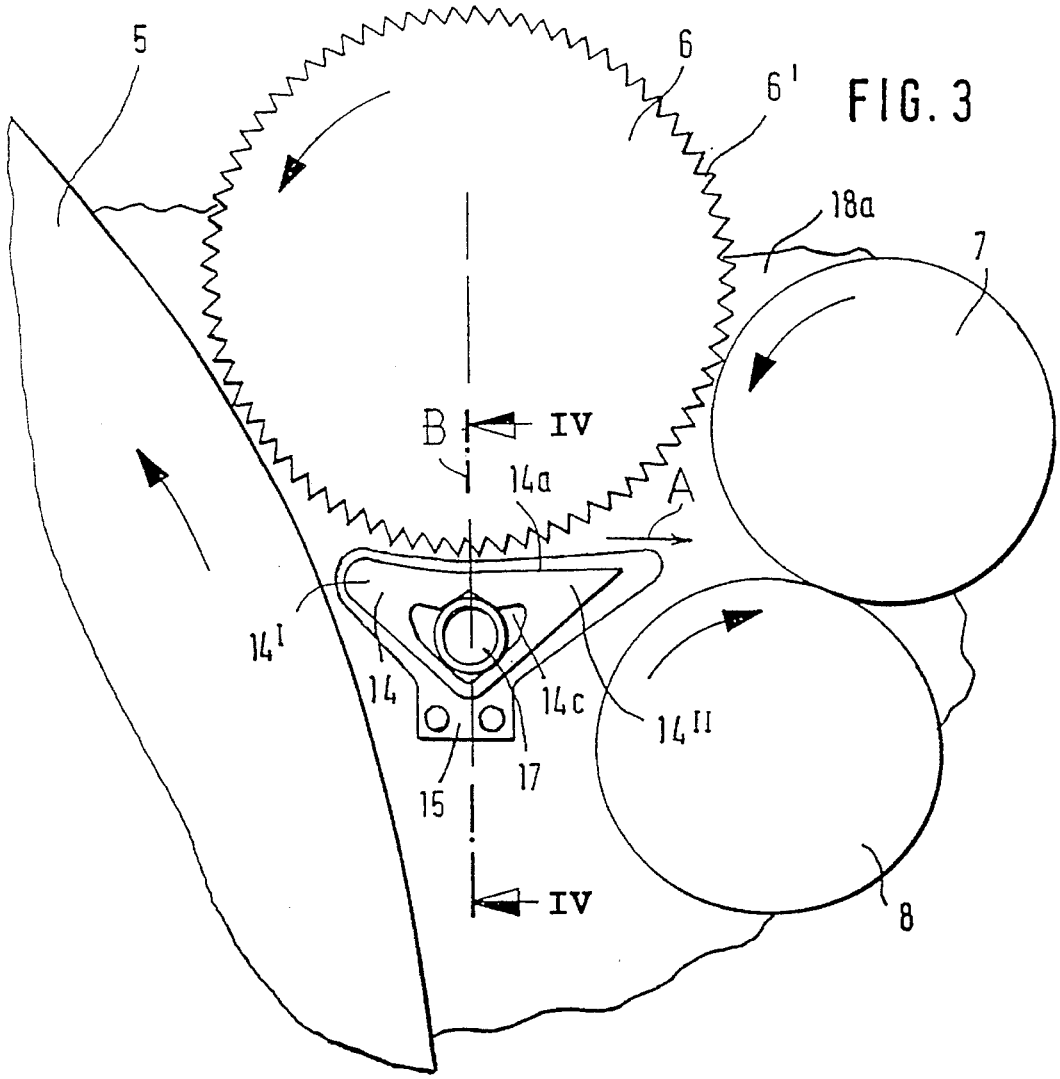
FIG. 3 is a side elevational view of another embodiment of the invention shown in an installed state between the doffer, the stripping roll and the crushing roll pair of the carding machine.
Figure 4:
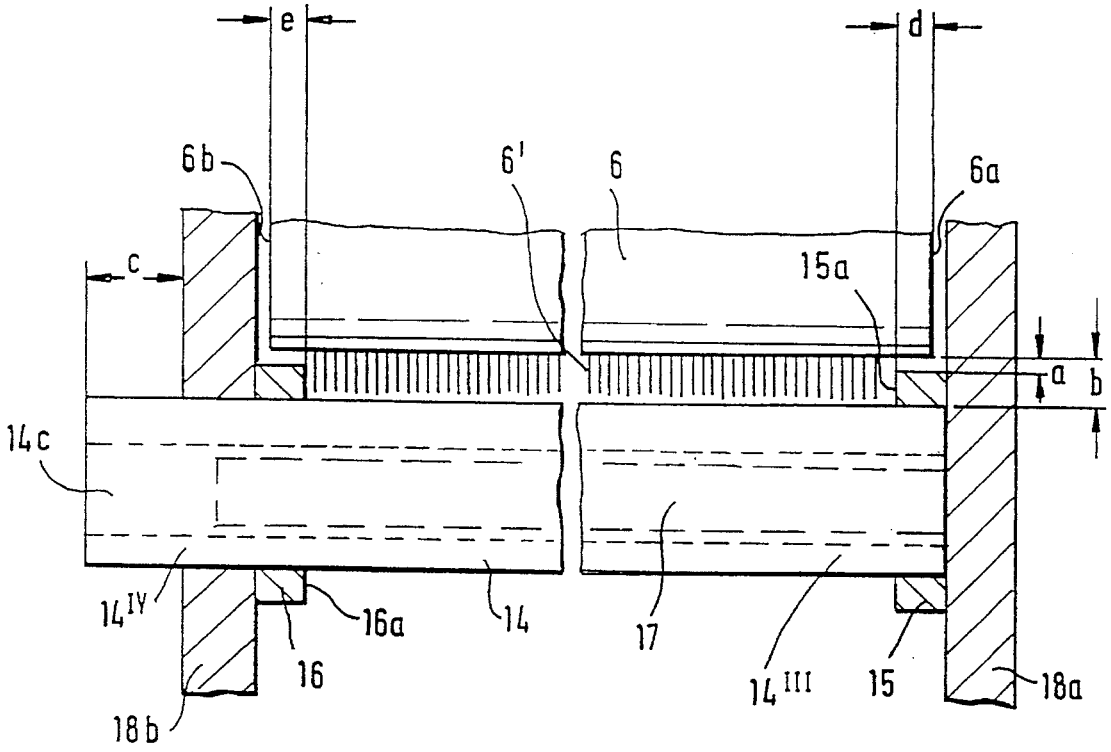
FIG. 4 is a sectional view taken along line IV—IV of FIG. 3.

The web supporting and guiding body 14 is shown in its installed state in FIGS. 3 and 4. As shown in FIG. 3, the upper surface 14*a* of the body 14 is oriented towards the clothing 6' of the stripping roller 6. The edge zone 14$^{I}$ is situated in the bight between the doffer 5 and the stripping roll 6. The other edge zone 14$^{II}$ is arranged in the region between the stripping roll 6 and the crushing rolls 7, 8, and the edge 14*b* is oriented toward the nip between the two crushing rolls 7, 8. The body 14 shown in FIGS. 3 and 4 is a one-piece extruded profiled member made, for example, of aluminum, having an inner, longitudinally extending space 14*c*.

For stationarily supporting the body 14 in the carding machine, two holding brackets 15 and 16 are provided which are affixed to inner faces of respective machine frame walls 18*a* and 18*b* between which the rolls of the card extend. Both brackets 15 and 16 have a generally triangular orifice complemental to the peripheral outline of the body 14, as may be observed in FIG. 3 for the bracket 15. The frame wall 18*b* has an aperture which generally conforms to and is aligned with the orifice of the holding bracket 16 so that, for installing the body 14, its longitudinal end portion 14$^{III}$ is pushed through the frame plate 18*b* and the holding bracket 16 to be eventually received by the holding bracket 15 where the end face of the longitudinal end portion 14$^{III}$ abuts the inner face of the frame plate 18*a*.

To facilitate insertion of the body 14, a guide bar 17 is provided which, at one end, is affixed to the inner face of the frame plate 18*a* and has a free end in the zone of the opposite frame plate 18*b*. Thus, upon insertion of the body 14, the bar 17 penetrates into the inner space 14*c* of the body 14 and guides the same across the width of the carding machine and assists insertion of the longitudinal end portion 14$^{III}$ into the holding bracket 15. As shown in the installed state in FIG. 4, the end portion 14$^{IV}$ is surrounded by the holding bracket 16. The body 14 may be secured by non-illustrated screws against displacements relative to the holding brackets 15 and 16. The end portion 14$^{IV}$ projects outwardly beyond the frame wall 18*b* at a distance c whereby a grip is provided, for example, for the purpose of replacing the body 14.

The distance a between the stripping roll 6 and the holding bracket 15 is less than the distance b between the stripping roll 6 and the surface 14*a* of the body 14. In a similar manner, the distance between the stripping roll 6 and the holding bracket 16 is less than the distance between the stripping roll 6 and the surface 14*a* of the body 14. The holding brackets 15, 16 overlap the respective ends of the stripping roll 6. The end face 15*a* of the holding bracket 15 is at a distance d from the associated end face 6*a* of the stripping roll 6, and, similarly, the end face 16*a* of the holding bracket 16 is at a distance d from the associated end face 6*b* of the stripping roll 6. In this manner, there is obtained in the zone of the distances a a very narrow gap so that dust, trash, short fibers and the like may not settle at those locations where no clothing 6' is present.

The surface 14*a* of the supporting and guiding body 14, particularly in the edge zone 14$^{I}$, serves as a supporting surface for the fiber web, while in the edge zone 14$^{II}$ it serves as a guiding surface, directing the fiber web into the nip of the crushing rolls 7, 8. The end zones 14$^{I}$ and 14$^{II}$ are on opposite sides of a vertical axial plane B of the stripping roll 6.

It will be understood that the above description of the present invention is susceptible to various modifications, changes and adaptations, and the same are intended to be comprehended within the meaning and range of equivalents of the appended claims.

What is claimed is:

1. A carding machine comprising (a) a main carding cylinder;

(b) a doffer cooperating with said main carding cylinder for removing fiber material therefrom;

(c) a stripping roll having a rotary axis and cooperating with said doffer for removing a fiber web therefrom; said stripping roll and said doffer together defining a bight;

(d) upper and lower cooperating crushing rolls together defining a nip for grasping the fiber web running from said doffer and said stripping roll; and (e) a fiber web supporting and guiding body stationarily positioned underneath said stripping roll; the body having a length dimension extending generally parallel to said axis; said body further having an upper surface for supporting and guiding thereon the fiber web; said upper surface having a width extending generally horizontally and transversely to said axis; said upper surface further having oppositely located first and second longitudinally extending edge zones; said first edge zone being situated in said bight and said second edge zone being situated in a region between said stripping roll and said crushing rolls and being oriented towards said nip; and said upper surface being oriented towards said stripping roll and having a concave course as viewed in a direction of said width.

2. The carding machine as defined in claim 1, wherein said body is a single-piece component.

3. The carding machine as defined in claim 1, wherein said width of said body extends to either side of a central vertical axial plane of said stripping roll.

4. The carding machine as defined in claim 1, wherein the upper crushing roll circumferentially immediately adjoins said stripping roll.

5. The carding machine as defined in claim 1, wherein said second edge zone of said body has a pointed edge.

6. The carding machine as defined in claim 5, wherein said pointed edge is at an approximate height level of said nip of said crushing rolls.

7. The carding machine as defined in claim 1, wherein said first edge zone of said body is rounded and said second edge zone of said body is pointed.

8. The carding machine as defined in claim 1, wherein the radius of curvature of said concave course is greater than the radius of said stripping roll.

9. The carding machine as defined in claim 1, wherein said body is an extruded member.

10. The carding machine as defined in claim 9, wherein said extruded member is aluminum.

11. The carding machine as defined in claim 9, wherein said extruded member is hollow.

12. The carding machine as defined in claim 1, further comprising (f) first and second opposite machine frame side walls; and (g) first and second holding brackets affixed to said first and second side walls, respectively; said first and second holding brackets supporting opposite longitudinal end portions of said body.

13. The carding machine as defined in claim 12, said stripping roll having a cylindrical surface carrying a clothing thereon; said stripping roll having axially opposite circumferential cylindrical surface end portions void of clothing; an axial clearance defined between said clothing and an end face of an adjacent said holding bracket being less than a radial distance between either said surface end portion of said stripping roll and said body.

14. The carding machine as defined in claim 12, said stripping roll having a cylindrical surface carrying a clothing thereon; said stripping roll having axially opposite circumferential cylindrical surface end portions void of clothing; a radial clearance defined between either said surface end portion of said stripping roll and an adjacent said holding bracket being less than a radial distance between either said surface end portion of said stripping roll and said body.

15. A carding machine comprising (a) a main carding cylinder;

(b) a doffer cooperating with said main carding cylinder for removing fiber material therefrom;

(c) a stripping roll having a rotary axis and cooperating with said doffer for removing a fiber web therefrom; said stripping roll having a cylindrical surface carrying a clothing thereon; said stripping roll having axially opposite circumferential cylindrical surface end portions void of clothing;

(d) upper and lower cooperating crushing rolls together defining a nip for grasping the fiber web running from said doffer and said stripping roll;

(e) a fiber web supporting and guiding body stationarily positioned underneath said stripping roll; the body having a length dimension extending generally parallel to said axis; said body further having an upper surface for supporting and guiding thereon the fiber web; said upper surface having a width extending generally horizontally and transversely to said axis; said upper surface further having oppositely located first and second longitudinally extending edge zones; said first edge zone being situated in a region between said doffer and said stripping roll and said second edge zone being situated in a region between said stripping roll and said crushing rolls and being oriented towards said nip;

(f) first and second opposite machine frame side walls; and (g) first and second holding brackets affixed to said first and second side walls, respectively; said first and second holding brackets supporting opposite longitudinal end portions of said body; a radial clearance defined between either said surface end portion of said stripping roll and an adjacent said holding bracket being less than a radial distance between either said surface end portion of said stripping roll and said body, and each said first and second holding bracket overlapping said circumferential end portion of said stripping roll and being at a radial clearance therefrom.

16. A carding machine comprising (a) a main carding cylinder;

(b) a doffer cooperating with said main carding cylinder for removing fiber material therefrom;

(c) a stripping roll having a rotary axis and cooperating with said doffer for removing a fiber web therefrom;

(d) upper and lower cooperating crushing rolls together defining a nip for grasping the fiber web running from said doffer and said stripping roll;

(e) a fiber web supporting and guiding body stationarily positioned underneath said stripping roll; the body having a length dimension extending generally parallel to said axis; said body further having an upper surface for supporting and guiding thereon the fiber web; said upper surface having a width extending generally horizontally and transversely to said axis; said upper surface further having oppositely located first and second longitudinally extending edge zones; said first edge zone being situated in a region between said doffer and said stripping roll and said second edge zone being situated in a region between said stripping roll and said crushing rolls and being oriented towards said nip;

(f) first and second opposite machine frame side walls; and (g) first and second holding brackets affixed to said first and second side walls, respectively; said first and second holding brackets supporting opposite longitudinal end portions of said body; each said holding bracket having an opening receiving respective said opposite longitudinal end portions of said body; said first machine frame side wall having an aperture aligned with said opening of said first holding bracket, whereby said body may be pushed through said first holding bracket toward said second holding bracket.

17. The carding machine as defined in claim 16, wherein said body is hollow; further comprising an elongated guide bar extending generally parallel to said rotary axis and being in alignment with said openings of said first and second holding brackets; said guide bar having a first end supported by said second side wall and a free, second end situated in a zone of the opening of said first holding bracket; upon installation, said body is introduced through said opening in said first side wall and inserted on said guiding bar and slid therealong until an end of said body passes through the opening of said second holding bracket and abuts said second side wall.

18. The carding machine as defined in claim 16, wherein the opening of at least one of the first and second holding brackets and a circumferential outline of said body are of complemental shape, whereby said at least one opening form-fittingly receives said body.

19. The carding machine as defined in claim 16, wherein a longitudinal end portion of said body projects outwardly from said aperture of said first side wall.

* * * * *